United States Patent [19]

Péhé

[11] 4,002,938

[45] Jan. 11, 1977

[54] X-RAY OR RAY IMAGE TUBE

[75] Inventor: Jean Pierre Péhé, Paris, France

[73] Assignee: Thomson-CSF, Paris, France

[22] Filed: July 8, 1975

[21] Appl. No.: 593,926

[30] Foreign Application Priority Data

July 12, 1974 France ..... 74.24637

[52] U.S. Cl. ..... 313/101; 250/213 VT

[51] Int. Cl.[2] ..... H01J 39/18; H01J 39/06

[58] Field of Search ..... 313/94.507, 101; 250/213 VT

[56] References Cited

UNITED STATES PATENTS

| | | | |
|---|---|---|---|
| 2,698,912 | 1/1955 | Teves et al. | 313/101 X |
| 3,163,765 | 12/1964 | Niklas | 313/101 X |
| 3,246,200 | 4/1966 | Kanter | 313/94 X |

*Primary Examiner*—Robert Segal

*Attorney, Agent, or Firm*—Roland Plottel

[57] ABSTRACT

The input screen 5 of an X-ray or $\gamma$ ray image tube comprises a barrier layer 54 between scintillator 51 and photocathode 55, made of two sub-layers, one 52 of alumina, $Al_2O_3$, 50 to 150 angstrom units in thickness, and the other of silicon sesquioxide $Si_2O_3$, 200 to 1000 angstrom units in thickness. The photocathode is made of an alkaline antimonide and the scintillator of an alkaline halide.

2 Claims, 3 Drawing Figures

X-RAY OR RAY IMAGE TUBE

The present invention relates to an X-ray or $\gamma$ ray image tube.

A tube of this kind comprises an input screen exposed to the incident X-ray or $\gamma$ radiation coming from the object whose image is to be produced. The screen is constituted in such a fashion as to emit electrons under the effect of the incident radiation, when a voltage is applied to it. This voltage is applied in order to direct the electron beam emitted by the input screen, onto a second screen or output screen of luminescent kind, impact of electrons on which produces a light trace. This trace constitutes the visible image of the object.

The present invention relates to the design of the input screens of these tubes.

These screens comprise, on a substrate which is transparent vis-a-vis the incident radiation, a scintillator and a photocathode which are separated by a barrier layer. The function of the scintillator is to convert the X-ray or $\gamma$ ray photons into optical photons to which the photocathode is sensitive, whilst the barrier layer provides chemical isolation between the two in order to prevent any reaction between them, something which would modify both the scintillator and the photocathode. This barrier layer must furthermore have the dual property on the one hand of absorbing the incident energy as little as possible during the course of the photon transformation which is taking place within the body of the screen, and on the other hand of retaining, as far as possible, the resolution of the photon image at the time of its transfer towards the photocathode. With this objective in mind, attempts have been made to reduce as far as possible the thickness of these layers in particular in relation to those of certain prior art embodiments in which they were consituted by a glass plate several tenths of millimeters in thickness, doing duty as substrate both for the scintillator and the photocathode, which were applied to either side of the plate.

In the prior art, various solutions designed to reconcile these two requirements, have been proposed; amongst these solutions, certain of them utilize, in particular in order to manufacture thin barrier layers, oxides of aluminium or silicon. See in particular U.S. Pat. Application Ser. No. 257.538, May 30, 1972.

However, recent work by the applicants have shown that a substantial improvement in the sensitivity of these screens is achieved using barrier layers made of oxides of both of these metals together, in an arrangement of critical proportions, in a manner described hereinafter.

In order to provide a better understanding of the invention, reference will now be made to the ensuing description and the related figures where:

Figure 1:
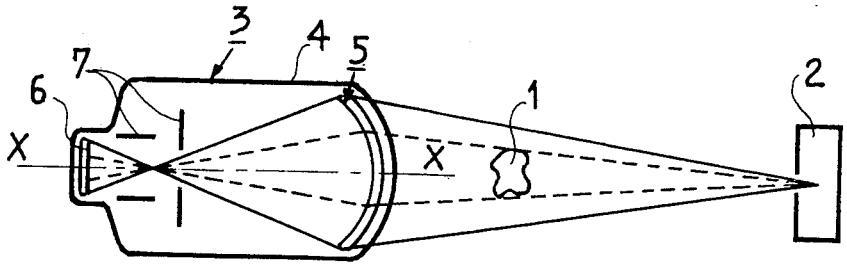
FIG. 1 is a schematic sectional view of an X-ray or $\gamma$ ray image tube.

In the diagram of FIG. 1, the general appearance of an X-ray or $\gamma$ ray device can be seen. Reference 1 in this figure designates the object whose image is to be produced, 2 a radiation source which irradiates said object and 3 the image tube whose axis is referenced XX and which comprises, within an evacuated envelope 4, an input screen 5 which receives the incident radiation coming from the source and delimited by the oblique lines at the right-hand side of the figure, that part of which radiation passing through the object is itself delimited by the broken lines in this part of the figure. This screen, under the effect of said radiation and when a voltage is applied to it, emits electrons which are directed towards the second screen of the tube, the output screen 6, by means of various electrodes the assembly of which has been marked by the reference 7 and is in accordance with the conventional techniques of electron optics. The screen 6, under the effect of the impact of the electrons of the beam (oblique lines in the left-hand part of the figure), produces a visible image of the object 1 which can be viewed directly or by any other optical viewing system.

Commencing from the known prior art, the applicants have undertaken trials in order to form a thin barrier layer for the input screen 5, using oxides of both the said metals, namely aluminium and silicon, in the case of a scintillator made of an alkaline halide such as thallium-activated or sodium-activated cesium iodide, thallium-activated potassium iodide, and a photocathode made of an alkaline antimonide of one or more of the metals comprised in the group sodium, potassium, cesium. These trials have resulted in the applicants utilizing, in order to form said barrier layers, oxides of the said two metals at the same time, distributed in the form of two superimposed sub-layers. They have also shown that if, as far as the oxidized silicon is concerned, the thickness of the sub-layer used is of no major influence within wide limits, upon the performance of the input screen, this is not so with the aluminium oxide sub-layer, which turns out to be critical.

Figure 2:
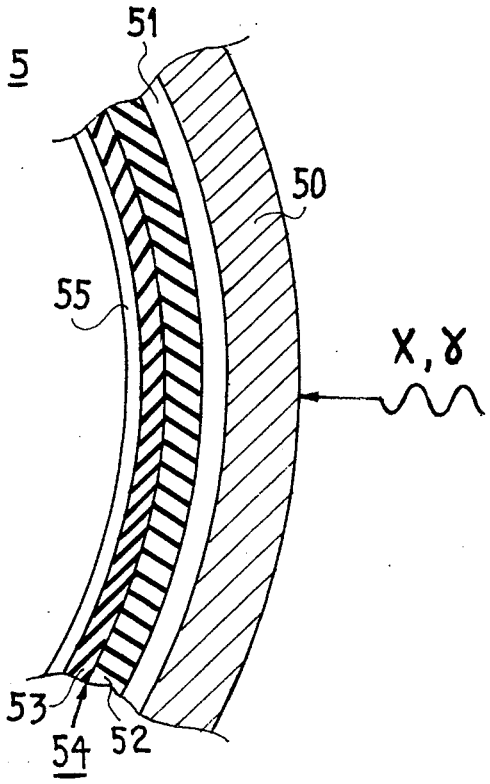
FIG. 2 is a section of a portion of the input screen of a tube of this kind in accordance with the invention.
Figure 3:
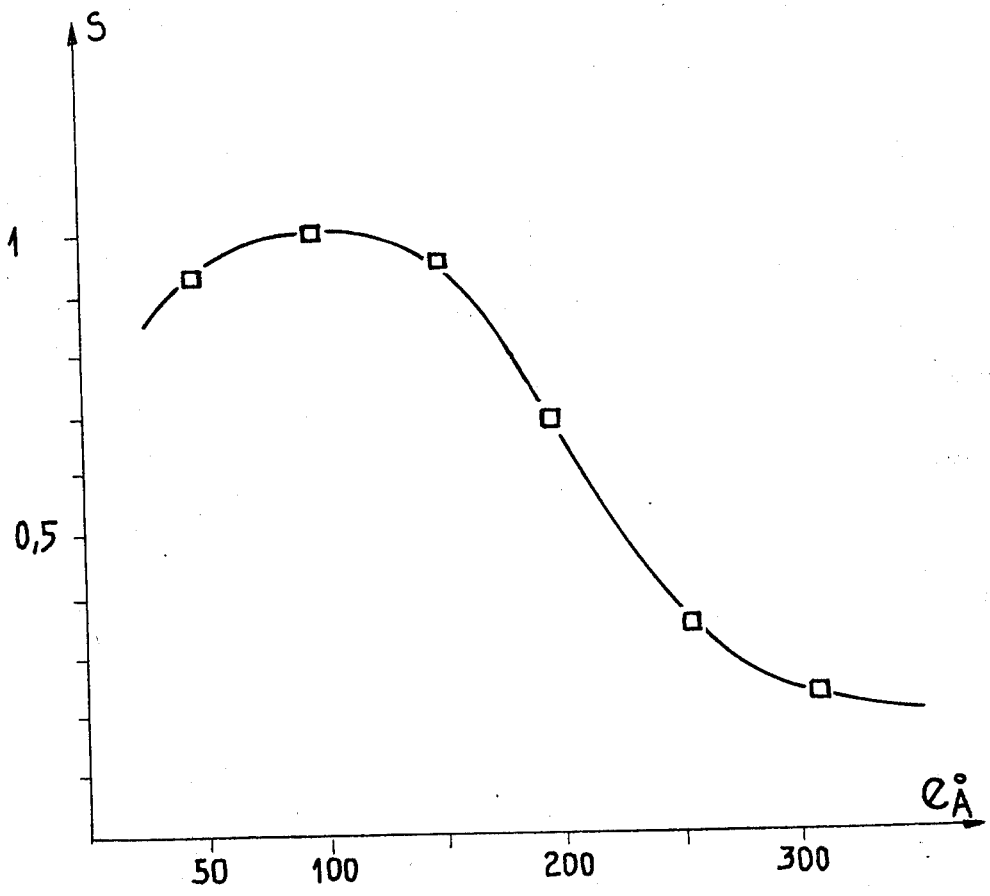
FIG. 3 is a diagram relating to the preceding screen.

The applicants have shown that the best sensitivity on the part of the screen was obtained, other things being equal, by making the barrier layer in the form of two sub-layers, the first, applied on the scintillator, being made of $Al_2O_3$ and the other applied on the former, being made of silicon sesquioxide $Si_2O_3$, as illustrated in the section of FIG. 2 where 50 represents a concave substrate, 51 the scintillator, 52 the first sub-layer and 53 the second sub-layer the assembly of which two latter layers constitutes the barrier layer 54 proper; the reference 55 designates the photocathode applied on the barrier layer. For a given thickness on the part of the second sub-layer, which ranges within wide limits, between 200 and 1000 angstrom units, it appears that the optimum thickness of the first of the sub-layers, of $Al_2O_3$, is between 50 and 150 angstroms. This result is that indicated by the graph of FIG. 3 which plots on the ordinates the sensitivity S of the tube as a function of the thickness $e$ (FIG. 2) in angstrom units of the alumina sub-layer, for a thickness on the part of the sesquioxide sub-layer, ranging between the above-indicated limits. This sensitivity is measured at constant incident illumination by the luminance of the image on the output screen; the peak of the graph has been assigned the value $S = 1$. This sensitivity was two times better than that obtained with the same tube when equipped with a screen having a barrier layer wholly made of silicon sesquioxide, $Si_2O_3$, 200 to 1000 angstrom units in thickness or of alumina, $Al_2O_3$, 50 to 100 angstrom units in thickness. In addition, form the chemical point of view, the efficiency of the barrier layer thus constituted was as good as that of a glass plate 2/10 mm in thickness; those skilled in the art will be aware that this kind of plate has a very high efficiency in preventing chemical reactions between scintillator and photocathode.

This efficiency underwent no degradation with time, as duration trials have shown, on a batch of several tubes over a period generally considered as being amply sufficient to judge any degradation of the input screen due to loss of efficiency of the barrier layer, which degradation, when it does happen normally takes place rapidly.

In the following, by way of indication some details concerning the preparation of the above-described screens have been given.

On the sub-assembly constituted by the screen and the scintillator and prepared by one of the known methods, there is formed by one of the known methods an alumina layer covering the scintillator, for exemple the layer being produced by vaporization of aluminium under vacuum in order to produce upon the scintillator a layer 50 angstrom units in thickness, the vaporization being followed by oxidization in air in order to bring the value of said layer thickness to a figure between 50 and 100 angstrom units as indicated hereinbefore. The oxidization in question can be carried out at the same time as the preceding vaporization by performing said vaporization under reduced pressure of the order of $10^{-5}$ to $10^{-4}$ mm/hg, in an oxidizing oxygen atmosphere, water vapor atmosphere etc. Good results have also been obtained by vaporizing an aluminium charge heated by electron bombardment in the same oxidizing atmosphere under reduced pressure.

On the alumina sub-layer thus constituted there is deposited a layer of silicon sesquioxide $Si_2O_3$, obtained by vaporization carried out in an oxidizing atmosphere under reduced pressure ($10^{-5}$ to $10^{-4}$ mm/hg), of silicon monoxide SiO; the silicon monoxide is raised during the course of this operation to a temperature between 1050 and 1200° C in a crucible heated by the Joule effect for example. The rate of deposition under these conditions is of the order of a fraction of an angstrom unit to some few angstrom units in thickness, per second.

After these operations, a component ready for assembly in the image tube is obtained. Once the thus prepared sub-assembly has been installed in the tube in the manner shown in FIG. 1, for example, there is carried out, in the tube, the formation of the photocathode, this in the form of a layer of one of the aforementioned materials applied to the silicon sesquioxide layer by one of the known methods, for example vaporization under vacuum. In certain embodiments, this sub-assembly forms an integral part of the envelope, of which it occupies one end.

It will be observed that during the preparation of the tube in accordance with the above-indicated process, which is a current one in the art, the sub-assembly formed by the substrate, the scintillator and the barrier layer of the input screens of these tubes, is exposed to the atmosphere during the transfer which takes place prior to its incorporation in the tube. The sesquioxide converts partially during this transfer into silicon dioxide $SiO_2$. This conversion involves only a fine film at the surface of the sesquioxide sub-layer, the latter through the major part of its thickness retaining its initial composition.

The barrier layer 54 turns out to be virtually inert vis-a-vis ambient atmospheric agents, thus ensuring excellent reproduciability under given conditions of manufacture.

What is claimed, is:

1. An X-ray or $\gamma$ ray image tube comprising an input screen receiving the incident radiation from the object, and a luminescent output screen, the two being separated by an evacuated space in which the electrons emitted in operation by said input screen under the effect of said radiation, are accelerated, their impact on said luminescent screen producing a visible image constituting the image of said object, said screen comprising a scintillator constituted by an alkaline halide, and a photocathode constituted by an alkaline antimonide, applied to either side of a barrier layer, characterised in that said barrier layer is constituted by two sub-layers applied one on top of the other, that applied to said scintillator and known as the first sub-layer, being constituted by alumina $Al_2O_3$ and having a thickness ranging between 50 and 150 angstrom units, and that in contact with the photocathode, and known as the second sub-layer, being constituted by silicon sesquixoide $Si_2O_3$.

2. An X-ray or $\gamma$ ray image tube as claimed in claim 1, characterised in that said second sub-layer has a thickness between 200 and 1000 angstrom units.

* * * * *